United States Patent [19]

Weise

[11] 4,097,718

[45] Jun. 27, 1978

[54] DEVICE FOR HEAT TREATING HAIR ON THE HUMAN HEAD, AND THE LIKE HAIR CURLING DEVICE HAVING SELF-REGULATING PTC HEATER

[75] Inventor: Hans Joachim Weise, Altenstadt, Germany

[73] Assignee: Braun Aktiengesellschaft, Frankfurt am Main, Germany

[21] Appl. No.: 649,099

[22] Filed: Jan. 14, 1976

[30] Foreign Application Priority Data

Feb. 1, 1975 Germany ..... 2504237

[51] Int. Cl.[2] ..... H05B 1/02; A45D 1/02; A45D 2/36

[52] U.S. Cl. ..... 219/222; 132/37 R; 219/225; 219/241; 219/505; 338/22 R; 338/260; 338/331

[58] Field of Search ..... 219/222, 225, 241, 504, 219/505; 338/22 R, 23, 260, 261, 295, 320, 331; 132/37 R, 37 A, 7, 9, 11 R, 31 R, 32 R, 33 R

[56] References Cited

U.S. PATENT DOCUMENTS

| | | | |
|---|---|---|---|
| 2,606,986 | 8/1952 | Sweger | 338/23 X |
| 3,375,774 | 4/1968 | Fujimura et al. | 338/22 R |

FOREIGN PATENT DOCUMENTS

| | | | |
|---|---|---|---|
| 1,234,251 | 6/1971 | United Kingdom | 219/331 |

*Primary Examiner*—A. Bartis
*Attorney, Agent, or Firm*—Michael J. Striker

[57] ABSTRACT

A hair curler includes an apertured cylindrical shell about which hair to be curled is wound. Mounted within the shell are two semicylindrical mounting components which donfine between themselves a plurality of spaced apart pill-shaped PTC resistor bodies. The engaging surfaces of the pill-shaped resistor bodies and of the semicylindrical mounting components are complementary and cylindrical, to establish good electrical and thermal contact between the engaging surface portions. Voltage is applied across the two semicylindrical mounting components, causing the generation of heat within the PTC resistor bodies. The PTC action of the latter causes an automatic limiting of temperature, preventing damage to hair. The generated heat is transmitted to a heating plate in contact with a wick extending into a water container. Water evaporates from the wick and steam passes into the interior of the apertured cylindrical shell, out through the apertures thereof, and into contact with the hair wound around the curler.

3 Claims, 7 Drawing Figures

SEMILOGARITHMIC DEPICTION OF PTC BEHAVIOR

PTC BEHAVIOR OF THREE TYPES OF PTC MATERIAL

STEADY-STATE VOLTAGE-CURRENT RELATIONSHIP OF TWO TYPES OF PTC MATERIAL

DYNAMIC VOLTAGE-CURRENT RELATIONSHIP OF A PTC MATERIAL

DEVICE FOR HEAT TREATING HAIR ON THE HUMAN HEAD, AND THE LIKE HAIR CURLING DEVICE HAVING SELF-REGULATING PTC HEATER

BACKGROUND OF THE INVENTION

The invention relates in general to devices and apparatus for heat-treating hair, particularly to devices, such as electrically heated hair curlers, electrically heated curling rods, electrically heated straightening rods, and the like, for heat treating hair on the human head.

It is well known, for example, to provide straight human hair with curls by wetting the hair and then winding each lock of hair around a respective hair curler made of synthetic plastic or metal. Thereafter, the hair is dried. For example, hot air can be blown against the hair using a hand-held hair drier. Alternatively, the user places her head under the heating dome of a full-size hair drier. This drying of the wound locks of hair causes the locks to assume to a very considerable extent the cylindrical form of the hair curlers. Once the hair has been completely enough dried, the hair curlers are removed. Thereafter, the hair is combed out and shaped and styled.

A disadvantage of this very well known procedure is the requirement for an external source of heat which must be either placed over the entire head of the user or held by hand and moved around the user's head near the hair to be dried, over and over again until the drying is completed.

Another method of curling the hair on the human head involves the use of scissors-like curling irons. The curling iron is first heated at an open flame and then brought into engagement with a lock of hair to form a wave in such lock. Important disadvantages of this known hair-waving technique are that the fingers of the user can easily be burned and that the curling iron must be heated repeatedly.

In view of the foregoing, it has already been proposed (for example in U.S. Pat. No. 3,535,392) to electrically heat the curling rod and hair curlers. These hair curlers are usually provided in their interiors with heating resistors having the form of heating coils. Usually associated with each such a resistive heating element is a thermostat device operative for preventing overheating of the heating element. It is extremely important to provide a thermostat device, because overheating of the heating element could cause injury to the scalp of the person whose hair is being treated. Employed for the thermostat is a bimetallic relay switch which performs certain conventional circuit functions when certain temperatures are exceeded and dropped below. An important disadvantage of bimetallic relays is that they are very susceptible to malfunction and furthermore are not particularly accurate in their operation.

SUMMARY OF THE INVENTION

It is a general object of the invention to provide electrically heated hair curling devices with temperature regulating means which operate in a more accurate and reliable manner than do bimetallic thermostatic relay switches.

This object can be achieved by employing a PTC (positive temperature coefficient) resistor for use as both the heating element and temperature regulating means of the hair curling or hair waving device.

According to a preferred concept of the invention, a plurality of pill-shaped PTC resistors are connected in parallel intermediate two semicylindrical heating blocks made of copper or another thermally and electrically conductive material.

According to another preferred concept of the invention, the PTC resistor has the form of a hollow cylinder.

According to the inventive concept, it is possible to perform both the heating function and the temperature regulation function using only a single component, whereas heretofore it was necesssary to use two separate components.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
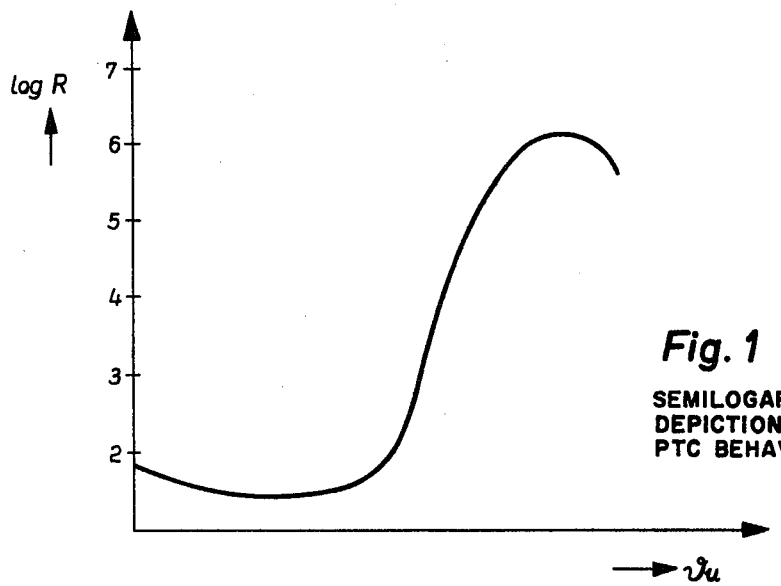
FIG. 1 depicts the dependence of a PTC resistor upon temperature.

FIG. 1 depicts in semilogarithmic manner the dependence of the resistance of a PTC resistor upon its temperature. As can be seen from the graph, at low temperatures the PTC resistor initially exhibits a negative temperature coefficient, but then at temperatures above the Curie temperature exhibits a very marked positive temperature coefficient, and finally in a still higher temperature range again exhibits a marked negative temperature coefficient. The shape of this characteristic curve distinguishes PTC resistors in the narrow sense of that term from PTC resistors in the broad sense of the term (for example ordinary electrical conductors such as copper or iron; see in this connection for example Moeller, "Grundlagen der Elektrotechnik," 10th Edition, 1959, pp. 20–22).

In general, PTC materials of the type in question are semiconductive ceramic materials. The materials are known per se. For example it is possible to make a semiconductive ceramic material of the type in question from $BaTiO_3$ or from solid solutions of $BaTiO_3$ and $SrTiO_3$ in a sintering process. If part of the barium or titanium ions in such a crystal structure is replaced by higher-valence ions, a certain number of free electrons will be made available. As examples, barium can be replaced by trivalent ions such as $La^{3+}$ or $Bi^{3+}$, and titanium can be replaced by ions such as $Sb^{5+}$ or $Nb^{5+}$. If these materials are then sintered in the absence of oxygen, the resulting product will exhibit a low negative temperature coefficient.

The PTC effect is produced by sintering the ceramic material in the presence of oxygen. When this is done, atmospheric oxygen penetrates along the pores and crystal boundaries into the crystal structure during the cooling down of the material after the sintering. The oxygen atoms deposit on the surfaces of the crystal and trap free electrons of the semiconductive crystal in a thin layer. This results in the establishment of potential barriers constituted by negative surface charge adjoined on either side by thin regions of positive space charge formed by now unsaturated impurity atoms. These potential barriers contribute a positive temperature coefficient resistance component which is added to the main resistance component and results in the desired positive temperature coefficient action. All this is per se well known in the art and further explanation is belived unnecessary. Further information on this subject is contained in the handbook, "Temperature Dependent Resistors," 1974, pages 167 et seq., of the VALVO Corporation, of Hamburg, Germany.

Figure 2:
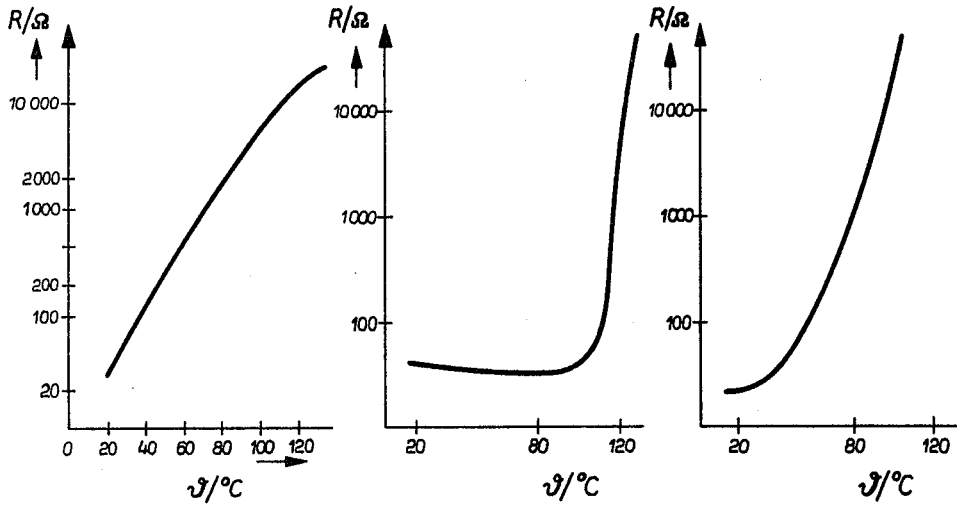
FIG. 2 shows the relationship between resistance and temperature for different types of PTC resistors.

FIG. 2 depicts in semilogarithmic manner the resistance-temperature characteristics of three different types of PTC materials. Because it is not possible to characterize the resistance-temperature characteristics of PTC materials by means of mathematical formulas, it is worthwhile to consider the characteristics, in graphical form, for three different types of PTC materials. In plotting each of the three curves shown in FIG. 2, very low voltage and currents were employed, to prevent heating up of the resistor by the measuring current itself, since such heating-up would accentuate the voltage-dependent character of the resistive material and detract from the significance of the plots. Accordingly, the plots shown in FIG. 2 are presently merely for the purpose of facilitating the identification and selection of materials which are suitable. The phenomenon of interest, namely the heating up of the resistive material by the current flowing therethrough, is not evident in the plots shown in FIG. 2. One thing that can be noted about the three plots shown in FIG. 2 is that, in the PTC region of each plot, the positive temperature coefficient is very high, i.e., the curve rises very steeply. This is in contrast to corresponding curves of materials such as metals where the positive temperature coefficient character is extremely slight and where the rise in resistence with increasing temperature is most extremely slight.

Figure 3:
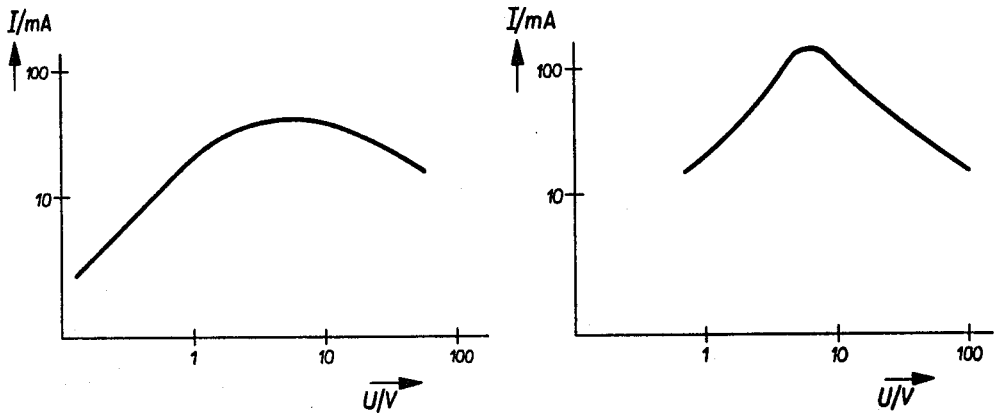
FIG. 3 depicts the relationship between current and voltage for two different types of PTC resistors.

FIG. 3 depicts the current-voltage curves of two different PTC materials. These curves represent the static characteristics of the material; i.e., when both the current and the voltage have settled to constant values they will be related as shown in the curve, and if the current or voltage is changed the new values which will become established after thermal equilibrium with the environment is restored will likewise be related as shown in the curve. Both the horizontal and vertical axes are logarithmic in FIG. 3, and it will be noted that initially the behavior of the PTC material corresponds to Ohm's law. However, above a certain temperature a current maximum is reached and thereafter, if the voltage is further increased, the current begins to decrease.

Figure 4:
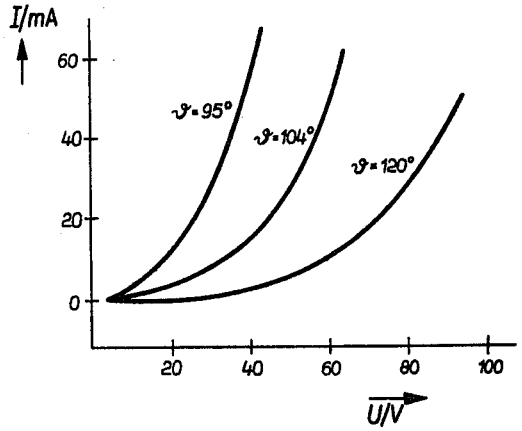
FIG. 4 depicts the dynamic characteristic of a PTC resistor.

The dynamic characteristic of a PTC resistor depicted in FIG. 4 is entirely different from the static characteristic depicted in FIG. 3. As can be seen from FIG. 4, the dynamic characteristic of a PTC material is like that of VDR (voltage dependent resistor). Thus, PTC resistors exhibit VDR characteristics in addition to and independent of their PTC characteristics. For the purposes of certain analyses, the PTC circuit component can be depicted as the parallel combination of, on the one hand, a first resistor exhibiting PTC characteristics but no VDR characteristics and capable of having applied across it a high maximum voltage and, on the other hand, a second resistor exhibiting VDR characteristics but no PTC characteristics and capable of having applied across it a considerably lower voltage.

With respect to both the static and also the dynamic characteristics of a PTC element, if the applied voltage is kept constant and the temperature of the element varies, the current flowing through the element will decrease in response to a rise of temperature. This means that the flow of current will adjust itself to the prevailing temperature conditions; if the temperature decreases then the current will rise; if the temperature rises, then less current will flow. For this reason, a PTC resistor can be made to behave as a temperature regulator operative for attempting to maintain its own temperature at a certain value, it being kept in mind that the level of current flow will determine the amount of heat being generated in the material of the PTC resistor. Thus, the PTC resistor can be used, on the one hand, as a heating element, for dissipating generated heat in the conventional manner, and, on the other hand, as its own thermostatic regulator. In other words the functions of heating element and thermostat are combined into a single element.

Figure 5:
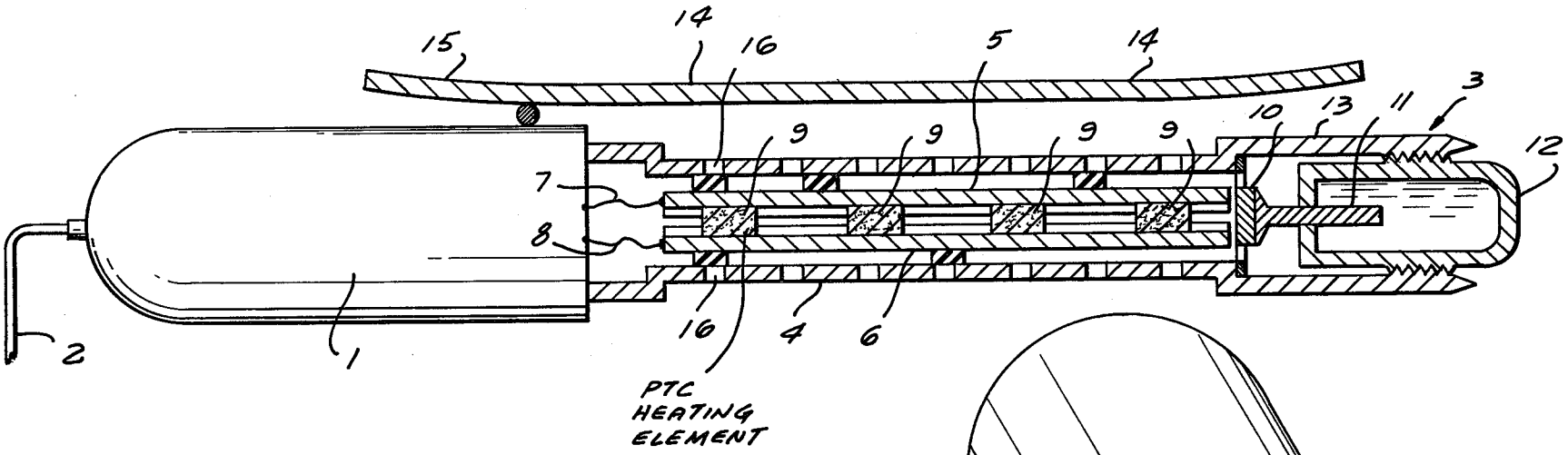
FIG. 5 depicts an electrically heated hair curler provided with a PTC resistor composed of a plurality of pill-shaped PTC resistor components.

FIG. 5 depicts an electrically heatable hair curler, somewhat along the lines of the one described in U.S. Pat. No. 3,835,292. However, unlike the hair curler shown in that patent, the hair curler of FIG. 5 does not include a heating element and a separate thermostat, but instead comprises a single PTC resistor serving both functions simultaneously.

Provided at one end of the stem 1 of the hair curler is the electrical energy supply line 2 and at the other side of stem 1 there is provided the actual heating structure 3. The heating structure 3 is in turn composed of a plurality of individual elements, of which the hair curler cylinder is denoted by numeral 4. Cylindrical portion 4 is the portion around which the lock of hair to be curled is actually wound. Inside cylindrical portion 4, spaced therefrom by insulating spacers 15, are two semicylindrical copper elements 5, 6 connected via respective conductors 7, 8 with the energy source to which line 2 is connected. Arranged intermediate the semicylindrical copper elements 7, 8 is a plurality of discrete pill-shaped PTC resistor bodies 9. Positioned opposite the pill-shaped PTC resistor bodies 9 is a heating plate 10 which becomes heated in consequence of the radiation of heat towards it from the bodies 9. Connected with heating plate 10 is a wick 11 which extends into a water container 12. The water container 12 is surrounded by an extension 13 of the cylindrical portion 4 of the hair curler, and can be screwed into such cylindrical portion.

If a lock of hair is to be cureled using the hair curler of FIG. 5, then the following is done:

By hand, the clip 14 with which the stem portion 1 is provided is depressed at location 15, thereby affording access to the cylindrical portion 4. The lock of hair to be curled is then wound around the cylindrical portion 4, whereupon the clip 14 is released and thereby prevents the wound lock from unwinding.

If now voltage is applied via lines 7, 8 across the two copper components 5, 6, current will flow through the pill-shaped PTC bodies 9, causing them to heat up. So long as the ambient temperature (in this situation the temperature of the wound lock of hair) is still low, a relatively high heating current flows through the PTC bodies, which in turn leads to an increase of the ambient temperature. However, when the ambient temperature has risen to a certain value, the heating current drops down to a low value just sufficient to effect the generation of heat in the pill-shaped bodies 9 at a rate corresponding to the loss of heat to the environment. Accordingly, thermal equilibrium with the environment will be established. It is particularly convenient and advantageous that such thermal equilibrium will, with virtually all of the PTC bodies commercially available, be established at a temperature suitable for the curling or waving of hair. If the ambient temperature decreases due to external factors, then the heating current will increase and thereby restore the ambient temperature to the thermal-equilibrium value. On the other hand, if for any reason the ambient temperature rises in a way which might otherwise result in overheating, overheating will be prevented by a large drop of the heating current.

The heat emitted from the pill-shaped bodies 9 heats up the heating plate 10 against which the aforementioned wicklike member 11 presses. Because wick 11 extends into the water container 12, water will evaporate at the heating plate 10. This water vapor passes around the heating plate 10 and escapes through holes 16 provided in the cylindrical portion 4 of the hair curler. Because the lock of hair to be curled is wound around the cylindrical portion 4, such hair will be dampened and in that way prepared for the curling operation. However, the curling phenomenon itself is attributable to the radiation of heat from the pill-shaped bodies 9.

The use of pill-shaped PTC bodies 9 in a certain sense represents a compromise solution; it is difficult to make PTC resistor bodies of arbitrarily selected shapes, and for the most part they can be made and are available most often as pill-shaped bodies. However, if desired, it would be possible to configurate the PTC resistor of FIG. 5 in a different manner; instead of using a plurality of pill-shaped component resistors, use could be made of a longer single element.

Figure 5A:
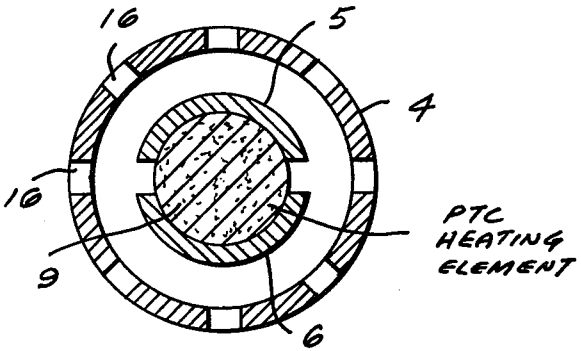
FIG. 5*a* is a transverse section through a part of the structure shown in FIG. 5.

FIG. 5*a* is a transverse section through a part of the structure of FIG. 5, showing the complementary-surface engagement between the inner surfaces of the semi-cylindrical mounting elements 5, 6 and the outer surfaces of the pill-shaped PTC resistor bodies 9.

Figure 6:
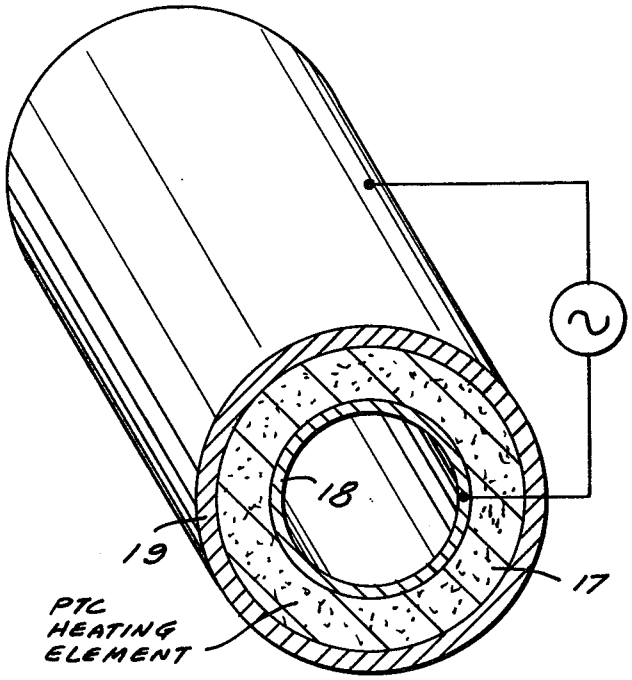
FIG. 6 depicts a portion of a differently designed hair curler in which the PTC resistor has the form of a hollow cylinder.

Another possible shape for the PTC resistor body is depicted in FIG. 6. There the PTC resistor 17 has the form of a cylindrical pipe provided with inner and outer metallic layers 18, 19. Voltage is applied across these two metallic layers 18, 19, so that heating current will flow from one metallic layer to the other through the PTC resistor.

Other configurations of the PTC resistor would be possible, and particularly if one takes into consideration the length-dependent radiation of heat one could even produce superior results.

It will be understood that each of the elements described above, or two or more together, may also find a useful application in other types of constructions differing from the types described above.

While the invention has been illustrated and described as embodied in an electrically heated hair curler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat-treating device, particularly for treating hair, comprising in combination, an outer hair-engaging structure about which hair to be curled or waved can be wound, the hair-engaging structure including holding means for holding hair in position on the hair-engaging structure; a combined heating and temperature regulating means within a cylindrical bore in the hair-engaging structure and including mounting means comprising a pair of mounting components made of thermally and electrically conductive material and defining an intermediate gap, and a plurality of cylindrical PTC resistor bodies located in the gap confined between the pair of mounting components in electrically conductive and thermally conductive engagement with the holding components, said PTC resistor bodies being spaced apart from one another within said gap; and means for applying a voltage across the pair of mounting components to establish a flow of heating current through the PTC resistor bodies, the mounting components being elongated generally semi-cylindrical components electrically connecting the cylindrical PTC resistor bodies in parallel, and the contacting surface portions of the mounting components and of the cylindrical PTC resistor bodies being cylindrical and complementary, thereby establishing good thermal and electrical contact between said contacting surface portions.

2. A hair-treating device as defined in claim 1, wherein the material of the PTC resistor bodies is a ceramic semiconductor material.

3. A hair-treating device as defined in claim 1, wherein the positive temperature coefficient of the material of the pill-shaped PTC resistor bodies is so high that above a certain temperature temperature increases produce corresponding heating current decreases counteracting such temperature increases so fully as to afford a thermostatic regulation.

* * * * *